US010794188B2

(12) United States Patent
Gaebler et al.

(10) Patent No.: US 10,794,188 B2
(45) **Date of Patent: *Oct. 6, 2020**

(54) ROTOR BLADE ASSEMBLY COMPRISING A RING-SHAPED OR DISC-SHAPED BLADE CARRIER AND A RADIALLY INNER REINFORCEMENT STRUCTURE

(71) Applicant: Rolls-Royce Deutschland Ltd & Co KG, Blankenfelde-Mahlow (DE)

(72) Inventors: Miklos Gaebler, Potsdam (DE); Sven Brueggmann, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 33 days.

This patent is subject to a terminal disclaimer.

(21) Appl. No.: 15/729,776

(22) Filed: Oct. 11, 2017

(65) Prior Publication Data

US 2018/0100398 A1 Apr. 12, 2018

(30) Foreign Application Priority Data

Oct. 12, 2016 (DE) ..... 10 2016 219 815

(51) Int. Cl.
*B63H 1/20* (2006.01)
*F01D 5/02* (2006.01)
*F01D 25/00* (2006.01)

(52) U.S. Cl.
CPC ..... *F01D 5/02* (2013.01); *F01D 5/022* (2013.01); *F01D 25/005* (2013.01);
(Continued)

(58) Field of Classification Search
CPC ..... F01D 5/3069; F01D 5/022; F01D 5/066; F01D 5/3007; F05D 2220/32; F05D 2240/90; F05D 2260/31; F05D 2300/6032
(Continued)

(56) References Cited

U.S. PATENT DOCUMENTS 1,178,452 A 4/1916 London
1,325,208 A 12/1919 Rice
(Continued)

FOREIGN PATENT DOCUMENTS

DE 10163951 * 12/2002 ..... F01D 21/045
DE 10163951 C1 12/2002
(Continued)

OTHER PUBLICATIONS

German Search Report dated Sep. 28, 2017 for counterpart German Application No. 10 2016 319 815.7.
(Continued)

*Primary Examiner* — Hung Q Nguyen
*Assistant Examiner* — Anthony Donald Taylor, Jr.
(74) *Attorney, Agent, or Firm* — Shuttleworth & Ingersoll, PLC; Timothy J. Klima

(57) ABSTRACT

A rotor blade assembly group for an engine with a ring-shaped or disc-shaped blade carrier having multiple rotor blades that are provided along a circle line about a central axis of the rotor blade assembly group, wherein the blade carrier has a carrier section that extends radially inwards in the direction of the central axis with respect to the rotor blades, the carrier section comprises a connection area, at which a stiffening structure with at least two, first and second, stiffening elements is fixedly attached, and the first stiffening element is arranged at a first face side of the blade carrier and the second stiffening element is arranged at a second face side that is facing away from the first face side. The first and second stiffening elements are connected to the connection area of the blade carrier and in addition are connected to each other.

11 Claims, 6 Drawing Sheets

(52) U.S. Cl.
CPC ..... *F05D 2220/32* (2013.01); *F05D 2240/20* (2013.01); *F05D 2250/75* (2013.01); *F05D 2260/38* (2013.01); *F05D 2300/6032* (2013.01)

(58) Field of Classification Search
USPC ..... 416/204 R
See application file for complete search history.

(56) References Cited

U.S. PATENT DOCUMENTS 3,501,249 A * 3/1970 Scalzo ..... F01D 5/3015 416/95
3,610,772 A * 10/1971 Wagle ..... F01D 5/06 416/198 A
3,610,777 A * 10/1971 Wagle ..... F01D 5/06 416/198 A
3,656,864 A * 4/1972 Wagle ..... F01D 5/22 415/174.4
3,765,796 A * 10/1973 Stargardter ..... F01D 5/282 416/218
3,787,141 A * 1/1974 Walsh ..... F01D 5/282 416/230
3,813,185 A * 5/1974 Bouiller ..... F01D 5/06 415/173.7
5,174,720 A * 12/1992 Gradl ..... F01D 5/3023 416/204 A
5,400,505 A * 3/1995 Wei ..... B22F 3/15 29/460
5,632,600 A * 5/1997 Hull ..... F01D 5/06 416/198 A
5,660,526 A * 8/1997 Ress, Jr. ..... F01D 5/02 416/198 A
6,213,720 B1 * 4/2001 Farmer ..... F01D 5/021 416/198 A
6,991,433 B2 * 1/2006 Mons ..... F01D 5/06 416/201 R
7,011,490 B2 * 3/2006 Albrecht ..... F01D 21/045 415/174.4
7,811,062 B1 * 10/2010 Twigg ..... F01D 5/147 416/218
7,918,644 B2 * 4/2011 Schreiber ..... F01D 5/06 415/199.5
2008/0025844 A1 * 1/2008 Bayer ..... C22C 47/00 416/221
2010/0189562 A1 7/2010 Blanchard et al.

FOREIGN PATENT DOCUMENTS

DE 10218459 B3 1/2004
DE 10358421 A1 7/2005

OTHER PUBLICATIONS

European Search Report dated Feb. 12, 2018 from counterpart European App No. 17195629.5.
German Search Report dated Sep. 26, 2017 for related German App. No. DE 102016219818.1.
European Search Report dated Feb. 12, 2018 from related European App No. 17195634.5.

* cited by examiner

ROTOR BLADE ASSEMBLY COMPRISING A RING-SHAPED OR DISC-SHAPED BLADE CARRIER AND A RADIALLY INNER REINFORCEMENT STRUCTURE

This application claims priority to German Patent Application DE10 2016 219 815.7 filed on Oct. 12, 2016, the entirety of which is incorporated by reference herein.

BACKGROUND

The invention relates to a rotor blade assembly group for an engine with a ring-shaped or disc-shaped blade carrier with multiple rotor blades.

Such a rotor blade assembly group can for example be part of a compressor or a turbine of the engine, in particular of a gas turbine engine. Here, the rotor blades are provided along a circle line about a central axis of the rotor blade assembly group, wherein this central axis usually coincides with the rotational or central axis of the engine. The blade carrier, at which the rotor blades are integrally formed or at which separately manufactured rotor blades are fixated via respectively one blade root, has a carrier section that extends radially inwards in the direction of the central axis with respect to the rotor blades. This carrier section usually forms a part of a disc body, which is formed—in consideration of the available installation space—with a comparatively large surface, so as to be able to withstand the loads that result from the fast rotation of the rotor blade assembly group about the central axis as they occur during operation of the engine. The higher the rotational speed of the blade carrier with the rotor blades and thus the load on the blade carrier, the larger the carrier section and consequently the weight of the blade carrier.

What is proposed in DE 101 63 951 C1 and DE 102 18 459 B3 for reducing the weight of a rotor blade assembly group and a rotor comprising the same is to provide a stiffening structure with first and second stiffening elements made of a metal matrix composite ("MMC", in short) at the blade carrier at a connection area of the carrier section. At that, respectively one stiffening element is embodied as a fiber-reinforced MMC ring and is arranged at respectively one face side of the blade carrier. Thus, for example two MMC rings are fixedly attached in a mirror-inverted manner at a connection area of a radially inwardly extending carrier section of a blade carrier, and namely at a first frontal face side and at a second rear face side of the blade carrier. Through the additional stiffening elements in the form of MMC rings, higher rotational speeds can be applied to the blade carrier while the carrier section has a smaller radial extension, and thus the blade carrier can be subjected to higher loads. Thanks to the MMC rings, the weight of the blade carrier is considerably lower as compared to a blade carrier with the same loadability having a larger carrier section.

In the rotor blade assembly groups that are proposed in DE 101 63 951 C1 and DE 102 18 459 B3, the stiffening elements in the form of the MMC rings are fixated independently of each other in a form-fit manner at respectively one face side of the carrier section, and where necessary additionally shrunk onto an axially extending projection of the connection area. At that, each MMC ring is separately axially secured at the respective face side of the carrier section and arranged above the corresponding axially extending projection at the connection area of the carrier section with respect to a radially outwardly pointing transverse direction. The fixation and in particular axial securing of the individual stiffening elements in the form of MMC rings is thus comparatively laborious. Further, the manufacture of the blade carrier with the connection area, which has to additionally integrate a form-fit axial securing possibility, is complicated and entails relatively high costs.

SUMMARY

The invention is thus based on the objective to provide a rotor blade assembly group that is improved in this respect, and in which the previously mentioned disadvantages are avoided or at least reduced.

This objective is achieved with rotor blade assembly groups with features as described herein.

What is proposed according to a first aspect of the invention is a rotor blade assembly group for an engine with a ring-shaped or disc-shaped blade carrier having multiple rotor blades, in which at least two, first and second, stiffening elements of a stiffening structure, which is fixedly attached at a connection area of a carrier section of a blade carrier, are respectively connected not only to the connection area, but in which also the first and second stiffening elements are additionally connected to each other.

Through the additional connection of the stiffening elements, which are arranged at different face sides of the blade carrier, an axial securing of the stiffening elements at each other and with respect to the blade carrier is achieved, without each individual stiffening element itself having to be separately axially secured at the carrier section of the blade carrier. Here, according to the first aspect of the invention, the solution according to the invention is based on the basic idea that, at the connection area of the blade carrier, stiffening elements are arranged at first and second face sides of the blade carrier that are facing away from each other—with the stiffening elements being preferably embodied so as be symmetrical to a transverse direction that extends radially with respect to the central axis and so as to be facing each other —, and that are axially secured through their additional connection to each other (with respect to the central axis).

Here, in one embodiment variant, the axial securing of both stiffening elements of the stiffening structure is realized via at least one separate connection element of the stiffening structure that directly connects the two stiffening elements arranged at different face sides, and secures them axially with respect to each other. In this manner, none of the stiffening elements is axially displaceable relative to the other stiffening element. Both stiffening elements are thus supported at the carrier section in a position according to the intended use.

At that, the solution according to the invention is principally independent of whether the rotor blades are formed integrally with the blade carrier, and the rotor blade assembly group is thus realized in Bling or Blisk design, or whether the rotor blades are separately manufactured and fixated at the blade carrier. In one embodiment variant, the ring-shaped or disc-shaped blade carrier is for example equipped with multiple individual rotor blades, which are respectively fixated at the blade carrier via a blade root of a rotor blade.

In one embodiment variant, a previously mentioned separate connection element for the connection of the first and second stiffening elements, which are arranged at different face sides of the blade carrier, to each other extends through a passage hole in the carrier section. This passage hole can be a central passage hole through the blade carrier, for example in the form of a bore. In that case, the at least one separate connection element for example extends through such a central passage hole of the blade carrier, so as to axially fixate the two stiffening elements relative to each other.

In particular in this case, the at least one separate connection element can at least partially enclose the first and second stiffening elements, so that at least parts of both stiffening elements are received between two sections of the connection element inside a cross section along the central axis. The connection element can for example have a U-shaped cross section, so that both stiffening elements, which are arranged at different face sides of the blade carrier, are received at least partially between two radially protruding legs or edges of the connection element.

Alternatively or additionally, the at least one connection element can be formed as a tensioning part that is held in a form-fit and/or force-fit manner at both first and second stiffening elements, respectively exerting a force on the first or second stiffening element that is arranged in the connection area which acts in the direction of the other second or first stiffening element. Thus, the stiffening elements are for example tensioned against each other by means of the tensioning part. Here, the tensioning part itself is held in a form-fit and/or force-fit manner at both first and second stiffening elements, for example due to an extension of the tensioning part meshing with an opening or groove in the respective stiffening element, or reversely due to a lateral extension of the respective stiffening element meshing with an opening or groove of the tensioning part.

In one embodiment variant, it is provided that at least the first or second stiffening element is formed in a ring-shaped manner. In a further development, both stiffening elements are formed in a ring-shaped manner. Compared to multiple, for example ring-segment shaped, stiffening elements per face side, the ring-shaped design of one individual stiffening element per face side has the advantage that it is simpler and quicker to assemble.

In one embodiment variant, at least one of the first and second stiffening elements is manufactured at least partially from a metal matrix composite ("MMC", in short) for the purpose of weight reduction. Here, at least one of the first and second stiffening elements can have a core of a metal matrix composite provided with an exterior coating. The core may for example consist of a reinforced titanium in MMC design, i.e., in particular of a titanium matrix with a ceramic reinforcement.

In one embodiment variant, the blade carrier has a passage hole that extends axially, for example centrally, with respect to the central axis and that is radially delimited by an inner edge of the carrier section. A section of the first or second stiffening element that is formed by a metal matrix composite extends axially below this inner edge of the carrier section. Accordingly, it is provided in such a variant that the radially inner edge of the carrier section, which delimits the preferably centrally provided passage hole in the ring-shaped or disc-shaped blade carrier, is at least partially edged by the at least one stiffening element, for example with an L-shaped cross section, and a section of the stiffening element extends below the connection area with respect to a radially outwardly oriented transverse direction. Consequently, the section of the first or second stiffening element arranged at the first or second face side, which is made of a metal matrix composite, extends below the inner edge in the direction of the other face side, and consequently provides a support below this inner edge through the metal matrix composite. The extension of the metal matrix composite in the axial direction below an inner edge of the carrier section can thus serve to provide an additional support below the rotor blades and the thus formed circumferentially extending rotor blade row, and result in a more robust stiffening structure.

In one embodiment variant, the connection area forms at least one axial projection that is enclosed by a first or second stiffening element in a form-fit manner, so that the axial projection is received at least partially between a radially outer and a radially inner section of this stiffening element. In this way, an axially projecting section of the connection area extends between a radially outer and a radially inner section of the stiffening element. At that, the axial projection can for example be formed at the connection area so as to project locally in a web-like manner or so as to project circumferentially in a ring-shaped manner, and can for example be received between the two sections of the stiffening element inside a groove-shaped recess of the stiffening element. The form-fit enclosing of an axial projection of the connection area by at least one of the stiffening elements does not only allow for an improved force application into and support through the respective stiffening element, but also an improved connection of the respective stiffening element to the connection area of the blade carrier. In this manner, the stiffening element can for example be axially pushed on or plugged on in a simple manner at the face side of the blade carrier and the at least one axial projection, and is held at the blade carrier in a directly radially secured manner by means of the form-fit enclosing of the axial projection.

Alternatively or additionally to a form-fit enclosing of an axial projection of the connection area, the blade carrier can have a passage hole that extends axially with respect to the central axis and that is radially delimited by an inner edge of the carrier section, and a first or second stiffening element of the stiffening structure can extend axially with at least one section below this inner edge of the connection area. Thus, in that case, a first or second stiffening element of the stiffening structure extends with at least one section axially along the inner edge of the connection area from one face side in the direction of the other face side of the blade carrier. Through the extension of the stiffening element below the radially inner edge of the blade carrier, an improved support and stiffening of the blade carrier in the area of the carrier section can be achieved independently of the use of the metal matrix composite—and in particular independently of the design explained above, in which a section of the stiffening element made of a metal matrix composite extends axially below an inner edge.

Besides, the design of at least one axial connection area that is enclosed by the stiffening element in a form-fit manner as well as the axial extension of at least one section of a first or second stiffening element below an inner edge of the connection area for improving the mountability of the stiffening structure and the loadability of the blade carrier can be advantageously combined with an additional connection of the first and second stiffening elements arranged at different face sides of the blade carrier, but can also be used independently therefrom.

Accordingly, what is proposed according to a second aspect of the invention is a rotor blade assembly group for an engine with a ring-shaped or disc-shaped blade carrier having multiple rotor blades, in which a stiffening structure is provided that has at least one stiffening element at a first or second face side of the blade carrier. At that, the connection area according to the second aspect of the invention forms at least one axial projection that is enclosed by the at least one stiffening element in a form-fit manner, so that the axial projection is received at least partially between a radially outer and a radially inner section of the stiffening element. Alternatively or additionally, it is provided according to the second aspect of the invention that the blade carrier has a passage hole that extends axially with respect to the central axis of the blade assembly group and that is radially delimited by an inner edge of the carrier section, and the at least one stiffening element of the stiffening structure extends axially below this inner edge of the connection area, that is, from the face side in the direction of the other face side, with at least one section.

An axial projection of the connection area can principally extend in parallel to the central axis and thus substantially perpendicular to a radially extending face side of the carrier section. However, the axial projection can also take an angle to the face side that is different from 90°.

Further, a transitional area between a substantially radially extending face-side carrier surface at the connection area and an end of the projection integrally formed therewith can be curved in a concave manner. Here, the degree of curvature and thus the course of a straight line at this transitional area can be chosen differently depending on the engine and/or the position of the rotor blade assembly group, depending on how strong the forces occurring at the connection area are and with which force components these extend, for example radially and tangentially. For instance, at the transitional areas, a straight line extends at an angle of 0° to 45° with respect to the radial direction. The degree of curvature and thus the enclosed angle can for example also be realized depending on the used manufacturing material for the stiffening element. In particular with a view to a metal matrix composite and the fibers provided therein, which can bear higher stresses in the circumferential direction about the central axis than in a tangential direction, a smaller angle and thus a stronger concave curvature for the transitional area (and thus a less "soft" transition between the face surface and projection) may be advantageous.

The at least one axial projection can be part of a profile of the connection area that has a T-shaped, I-shaped or firtree-shaped cross section. In a T-shaped profile, two projections that axially extend in opposite directions are integrally formed at the connection area. Accordingly, in a profile that is formed in an I-shaped manner, i.e., in the manner of the cross sectional profile of a double T-girder, two pairs of such two projections extending axially in opposite directions are provided, being arranged at a radial distance to one another. Provided in a firtree-shaped profile are at least two or three pairs of projections that extend axially in opposite directions and are arranged radially above each other and at a distance to each other, with their axial extension decreasing or increasing in a step-wise manner along a radial direction.

In one embodiment variant, a T-shaped, I-shaped or firtree-shaped profile of the connection area extends at least in certain sections along a circle line about the central axis. In a further development, the connection area of the ring-shaped or disc-shaped blade carrier is provided with a complete circumferential T-shaped, I-shaped or firtree-shaped profile.

In particular in a firtree-shaped cross sectional profile of the connection area, a for example ring-shaped stiffening element can be arranged at each face side of the blade carrier, being provided with a correspondingly matching cross sectional profile as a counter-part and encloses multiple axial projections, which are defined by the firtree-shaped cross sectional profile of the connection area, in a form-fit manner. By means of such a connection between a respective stiffening element and the connection area of the blade carrier, the radial loads that occur during operation of the engine can be guided more efficiently from the blade carrier into the stiffening structure. Here, the occurring forces are also introduced into the stiffening structure at different radial positions and thus in a distributed manner, so that the force transmission between the blade carrier and the stiffening structure is improved. Additionally, the connection and safe fixation of the stiffening structure at the blade carrier is considerably simplified.

In a possible further development, sealing elements and/or cooling openings can be provided at an axial projection of the connection area, in particular at an axial projection of a T-shaped, I-shaped or firtree-shaped cross sectional profile of the connection area. In that case, cooling openings may for example serve for supplying cooling air to the blade carrier.

What can in particular be provided with a rotor blade assembly group of the invention, according to the first as well as the second aspect of the invention, is a gas turbine engine in which the weight of one or multiple rotor blade rows of a compressor and/or of one or multiple rotor blade rows of a turbine is considerably reduced as compared to the rotor blade rows as they have been commonly used so far in practice, while at the same time the mounting of the stiffening structure and its axial securing is comparatively simple. At that, rotor blade assembly groups that respectively form one rotor blade row including the stiffening structures fixedly attached thereat according to the invention can be arranged axially behind each other and fixated at each other in a torque-proof manner. However, of course it is also possible to combine a rotor blade assembly group embodied according to the invention for forming a rotor blade row with a further rotor blade assembly group of a further rotor blade row that is not embodied according to the invention.

BRIEF DESCRIPTION OF THE DRAWINGS

The accompanying Figures illustrate possible embodiment variants of the invention by way of example.

DETAILED DESCRIPTION

Figure 6:
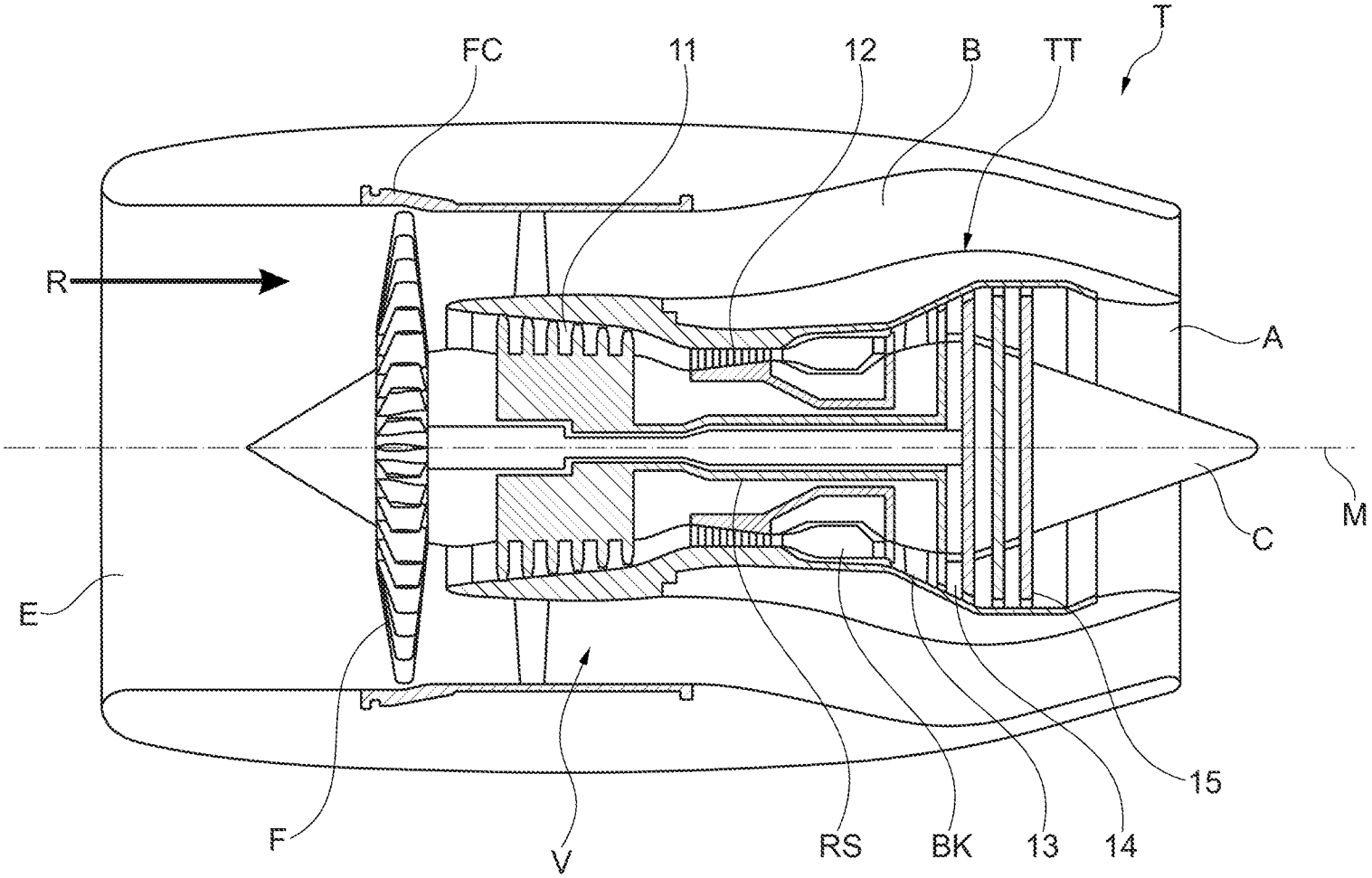
FIG. 6 shows a cross sectional view of a turbine engine in which one embodiment variant of a rotor blade assembly group according to the invention is used in the area of a compressor and/or in the area of a turbine.

FIG. 6 schematically illustrates, in a sectional rendering, a gas turbine engine T in which the individual engine components are arranged in succession along a rotational axis or central axis M. By means of a fan F, air is suctioned in along an entry direction E at an inlet or an intake E of the engine T. This fan F, which is arranged inside a fan housing, is driven via a rotor shaft S that is set into rotation by a turbine TT of the engine. Here, the turbine TT connects to a compressor V, which for example has a low-pressure compressor 11 and a high-pressure compressor 12, and where necessary also a medium-pressure compressor. The fan F supplies air to the compressor V, on the one hand, and, on the other hand, to a secondary flow channel or bypass channel B for generating a thrust. Here, the bypass channel B extends about a core engine that comprises the compressor V and the turbine TT, and also comprises a primary flow channel for the air that is supplied to the core engine by the fan F.

The air that is conveyed via the compressor V into the primary flow channel is transported into the combustion chamber section BK of the core engine where the driving power for driving the turbine TT is generated. For this purpose, the turbine TT has a high-pressure turbine 13, a medium-pressure turbine 14, and a low-pressure turbine 15. The turbine TT drives the rotor shaft S and thus the fan F by means of the energy that is released during combustion in order to generate the necessary thrust by means of the air that is conveyed into the bypass channel B. The air from the bypass channel B as well as the exhaust gases from the primary flow channel of the core engine are discharged via an outlet A at the end of the engine T. Here, the outlet A usually has a thrust nozzle with a centrally arranged outlet cone C.

As is known, rotor blade assembly groups which rotate about the central axis M and respectively have one rotor blade row and in which the rotor blades are provided at a ring-shaped or disc-shaped blade carrier, are used in the area of the (axial) compressor with its low-pressure compressor 11 and its high-pressure compressor 12 as well as in the area of the turbine TT. In principle, the ring-shaped or disc-shaped blade carrier can be integrally bladed, and can thus be manufactured in Bling or Blisk design. Alternatively, it is possible to fixate individual rotor blades at a ring-shaped or disc-shaped blade carrier via their respective blade roots. For this purpose, a blade root may for example be axially inserted into a fastening groove of the blade carrier and axially secured at the respective blade carrier.

Figure 5:
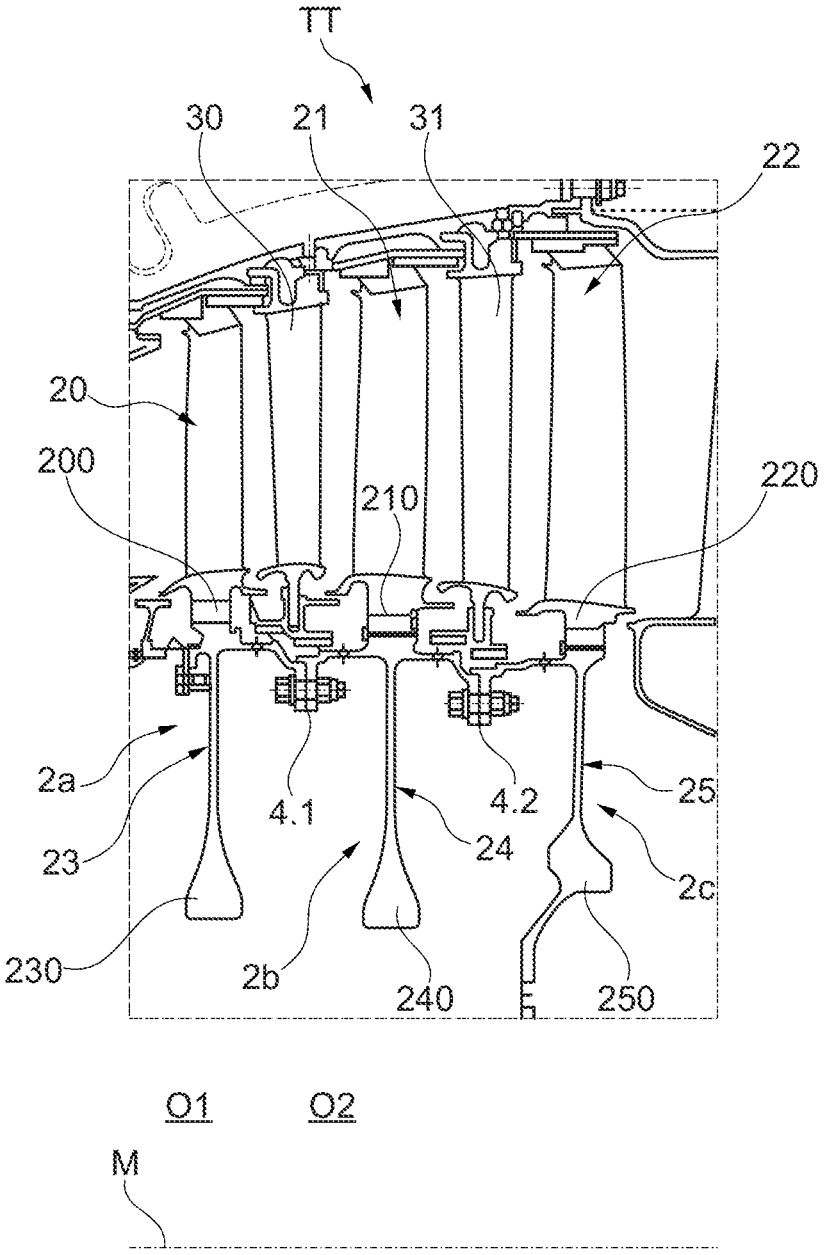
Fig. 5 (PRIOR ART)
FIG. 5 shows, by sections and in a sectioned rendering, a design of rotor blade rows of a turbine of the gas turbine engine as it is known from the state of the art.

By way of example, FIG. 5 illustrates multiple rotor blade assembly groups 2*a*, 2*b* and 2*c* of the turbine TT arranged behind each other along the central axis M. Here, the section that is shown in FIG. 5 depicts only a part above the central axis M in the area of the medium-pressure turbine 14 or the low-pressure turbine 15. The individual rotor blade assembly groups 2*a*, 2*b* and 2*c* are connected to each other in a torque-proof manner via flange connections 4.1 and 4.2. Further, each rotor blade assembly group 2*a*, 2*b* and 2*c* has respectively one ring-shaped or disc-shaped blade carrier 23, 24 or 25, at which individual rotor blades 20, 21 or 22 of a blade row are arranged behind each other along a circle line about the central axis M, and at which respectively blade carriers 23, 24 or 25 are fixated via a blade root 200, 210 or 220 of a rotor blade 20, 21 or 22. In the axial direction along the central axis M, rotor blade rows of the rotor blade assembly groups 2*a*, 2*b* and 2*c* alternate with stationary guide vane rows. The guide vane rows respectively have guide vanes 30 or 31 that are also arranged along the entire circumference on a circle line about the central axis M.

Due to the rotational speeds and the resulting loads, each blade carrier 23, 24 or 25 of a rotor blade assembly group 2*a*, 2*b* or 2*c* of the state of the art has a radially inwardly extending carrier section 230, 240 or 250. A disc-shaped carrier section 250 of the rear rotor blade assembly group 2*c* for example serves for the rotatable mounting of the rotor blade assembly groups 2*a*, 2*b* and 2*c* that are connected to one another in a torque-proof manner. In the carrier section 230, 240 of two (with respect to the flow direction through the engine T) frontal rotor blade assembly groups 2*a* and 2*b*, a central passage hole O1 or O2 is provided mainly for the purpose of weight reduction, for example in the form of a bore. With view to the necessary installation space of the rotor blade assembly groups 2*a* and 2*b* as well as their weight, it is most important which radial extension the blade carriers 23 and 24 have in order to be able to withstand the loads that occur during operation.

Figure 1:
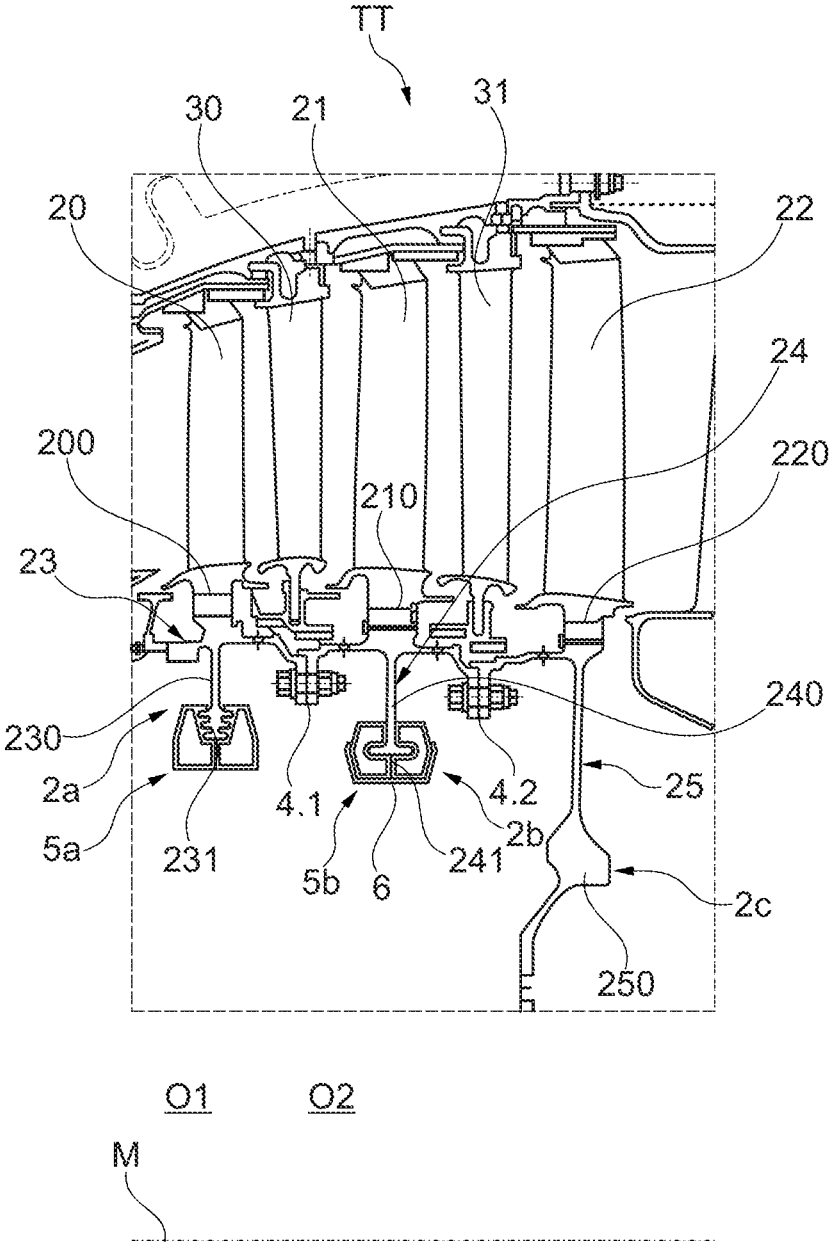
FIG. 1 shows, by sections and in a sectional rendering, a part of a turbine of a gas turbine engine with two embodiment variants of a rotor blade assembly group according to the invention.

In the different variants of a solution according to the invention, which are for example illustrated in FIG. 1 by way of example based on two rotor blade assembly groups 2*a* and 2*b* of the turbine TT, a considerable size reduction of the radially extending carrier sections 230 or 240 is achieved by providing a stiffening structure 5*a* or 5*b*. Here, both different variants are illustrated together in FIG. 1. However, it is not obligatory that different stiffening structures 5*a* and 5*b* are provided at a rotor blade assembly group 2*a* and another rotor blade assembly group 2*b*. In practice, it will be advantageous to use identically embodied stiffening structures 5*a* or 5*b* at different rotor blade assembly groups 2*a* and 2*b* to render the mounting easier and to be able to use as many identical parts as possible.

However, what different variants of stiffening structures 5*a* and 5*b* respectively have in common is that two ring-shaped stiffening elements, which are positioned opposite each other, are arranged in the form of (MMC) stiffening rings 50 and 51 at the face sides of the respective blade carriers 23 or 24. On the one hand, the stiffening rings 50 and 51 are directly connected to each other, preferably via at least one additional connection element. On the other hand, both stiffening rings 50, 51 respectively enclose one connection area 231 or 241 of the respective carrier section 230 or 240 in a form-fit manner at least in certain sections, with the carrier section 230 or 240 having a continuous profile in the circumferential direction that comprises at least two projections axially extending in opposite directions. Here, in the one variant of the rotor blade assembly group 2*a*, the connection area 231 is provided with a firtree-shaped (cross sectional) profile, while in the other rotor blade assembly group 2*b* of FIG. 1 a T-shaped cross sectional profile is provided.

Figure 2A:
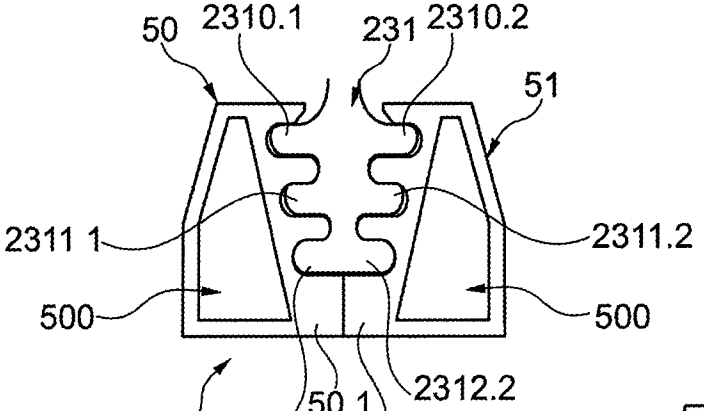
FIGS. 2A-2C shows, in enlarged rendering and by sections, a connection area of a blade carrier with different variants of a stiffening structure with MMC stiffening rings arranged thereat.
Figure 2B:
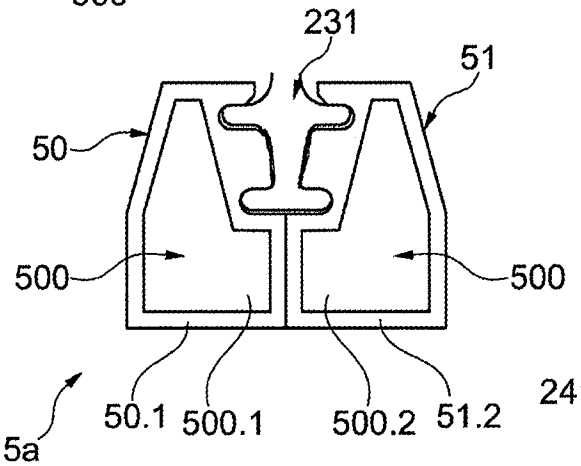
Figure 2C:
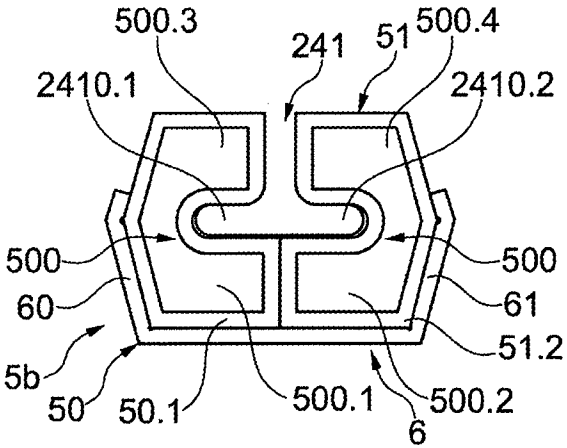

As is illustrated based on FIGS. 2A, 2B and 2C for different variants of the stiffening structures 5*a*, 5*b*, each stiffening ring 50, 51 of the respective stiffening structure 5*a* or 5*b* has a coated MMC core 500, for example a TiMMC core. By manufacturing the stiffening rings 50 and 51 in MMC design, a considerably increased stiffness of the blade carrier 23 or 24 is achieved, while at the same time it has a comparatively low weight. In each of the variants of the FIGS. 2A, 2B and 2C, a stiffening ring 50 or 51 axially extends with a enclosing section 50.1 or 51.2 below an edge of the connection area 231 or 241 that is facing towards the respective passage hole O1 or O2 in the direction of the other face side. Thus, each stiffening ring 50 or 51 at least partially encloses a radially internal edge of the respective blade carrier 23 or 24 in an L-shaped manner. In this manner, in particular the radial securing of the respective stiffening ring 50, 51 at the carrier section 230 or 240 is facilitated, and a support of the blade carrier 23, 24 below of the connection area 231, 241 is also achieved.

In the present case, both stiffening rings 50 and 51 extend so far axially below the inner edge of the carrier section 231 or 241 of the blade carrier 23 or 24 with respectively one enclosing section 50.1 or 51.2, that the stiffening rings 50 and 51 directly adjoin each other with their enclosing sections 50.1 and 51.2. Consequently, the stiffening rings 50 and 51 that are provided on both sides of the connection area 231 or 241 and that are respectively supported at the respective connection area 231 or 241 in a form-fit manner directly abut each other and the stiffening structure 5*a* or 5*b* thus created extends through the entire passage hole O1 or O2.

The stiffening structure 5*a* or 5*b* with the stiffening rings 50 and 51, which are arranged at face sides of the blade carrier 23 or 24 that are facing away from each other, mainly receives radially acting forces. But at the same time, a simpler mounting as well as a simpler radial securing of the stiffening rings 50 and 51 to be mounted at the blade carrier 23 or 24 is facilitated as a result of the circumferential profile of the connection area 231 or 241.

In a firtree-shaped cross sectional profile according to the variants of FIGS. 2A and 2B, the connection area 231, which is shown here by way of example, forms pairs of projections 2310.1/2310.2, 2311.1/2311.2 and 2312.1/2312.2 which axially extend in opposite directions. Each of these axial projections 2310.1 to 2312.2 protrudes in a ring-shaped manner at a face side of the carrier section 230. For forming the firtree-shaped profile, the axial length of the individual axial projections 2310.1 to 2312.1 or 2310.2 to 2312.2 decreases on each face side in the radial direction, in the present case radially inwards. Accordingly, a pair of axial projections 2312.1/2312.2, that is located closest to the passage hole O1, [has] the smallest axial extension, and the pairs of axial projections 2311.1/2311.2 and 2310.1/2310.2 that are arranged further radially outwardly respectively protrude further axially.

Provided at the individual stiffening rings 50 and 51 are grooves corresponding to the projections 2310.1 to 2312.1 or 2310.2 to 2312.2 of a face side, so that the stiffening ring 50 or 51 that is respectively attached at a face side encloses each projection 2310.1 to 2312.1 or 2310.2 to 2312.2 at the respective face side in a form-fit manner, and accordingly each projection 2310.1 to 2312.2 is respectively received between a radially further internally and a radially further externally positioned section of the respective stiffening ring 50 or 51. Through a form-fit connection between the blade carrier 23 and the stiffening rings 50 and 51 that is thus formed, radial loads as they occur during operation of the engine T are introduced into the stiffening structure 5*a* in a manner distributed across the firtree-shaped profile. In addition, the stiffening structure 5*a* is thus radially fixated at the carrier section 230 of the blade carrier 23 already by plugging on the stiffening rings 50, 51, without any additional fastening means.

For axially fixating the two stiffening rings 50 and 51, at least one connection element is provided, which is not shown in any more detail in FIGS. 2A and 2B. Via such a connection element, the two stiffening rings 50 and 51 are additionally directly connected to each other, so that any undesired displacement in the axial direction, and in particular a separation of the stiffening rings 50 or 51 from the blade carrier 23, is avoided. Each stiffening ring 50 or 51 is also supported at the other stiffening ring 51 or 50 via the at least one connection element, whereby any displacement relative to the same is avoided.

For instance, an individual connection element can be used. In one variant, this individual connection element can extend at the stiffening structure 5*a* circumferentially in a ring-shaped manner, or can extend at least across the larger part of a radially inner circumference of the stiffening structure 5*a*. Alternatively, multiple local connection elements can be provided for axial securing in a manner offset with respect to one another along the circumference.

For instance, a connection element 6 can be formed with a U-shaped cross section, as is shown in FIG. 2C for the stiffening structure 5*b*, wherein such a connection element 6 can also be used in a stiffening structure 5*a* of FIGS. 2A and 2B. Such a connection element 6 is connected in a form-fit and/or force-fit manner to both stiffening rings 50 and 51 via two legs or edges 60, 61 of the connection element 6. For fixating the connection element 6 at the stiffening rings 50, 51 that are embodied so as to be symmetrical to each other, a narrow groove is provided in every edge or leg 60, 61 into which respectively one extension in the form of a circumferentially extending, axially projecting edge or nose of the respective stiffening rings 50, 51 meshes.

In the cross sectional view, both stiffening rings 50 and 51 are received between the two legs or edges 60, 61 of the connection element 6. At that, a force can be applied to each of the stiffening rings 50, 51 via the two respectively radially extending edges or legs 60, 61 that engage at the face side, pressing the stiffening ring 50, 51 in the direction of the other stiffening ring 51 or 50. Thus, the connection element 6 acts as a tensioning part, that axially tensions the two stiffening rings 50 and 51 against each other.

In contrast to the variants of FIGS. 2A and 2B, in the embodiment variant of FIG. 2C the connection area 241 is not provided with a firtree-shaped profile, but with a T-shaped profile. The connection area 241 of FIG. 2C thus has two projections 2410.1 and 2410.2 that axially project in opposite directions. Also in this variant, they are respectively enclosed in a form-fit manner by the corresponding stiffening ring 50 or 51 that is arranged at the respective face side.

In the embodiment variants of FIGS. 2B and 2C, it is further provided that the respective MMC core 500 of a stiffening ring 50 or 51 extends below the inner edge of the carrier section 230 or 240 with at least one section 500.1 or 500.2 made of the metal matrix composite. In the variant of FIG. 2B, the MMC core has a substantially L-shaped cross section. In the variant of FIG. 2C, the MMC core 500 of each stiffening ring 50 or 51 is embodied with a C-shaped cross section. In the variant of FIG. 2A, the MMC core 500 is thus arranged only axially next to the connection area 231 and in particular next to the projections 2310.1 to 2312.2. In contrast to that, in the variant of FIG. 2B, the MMC core 500 is arranged axially next to the connection area 231 and at least partially below the connection area 231, and accordingly in particular next to the projections 2310.1 to 2312.2 and at least partially below the projections 2310.1 to 2312.2. Through the C-shaped cross section, also respectively one section 500.3 or 500.4 of the MMC core 500 is additionally arranged above a projection 2410.1 or 2410.2, and consequently an axial projection 2410.1 or 2410.2 of the respective frontal or rear face side is positioned between two sections 500.1/500.3 or 500.2/500.4 of metal matrix composite.

Figure 3B:
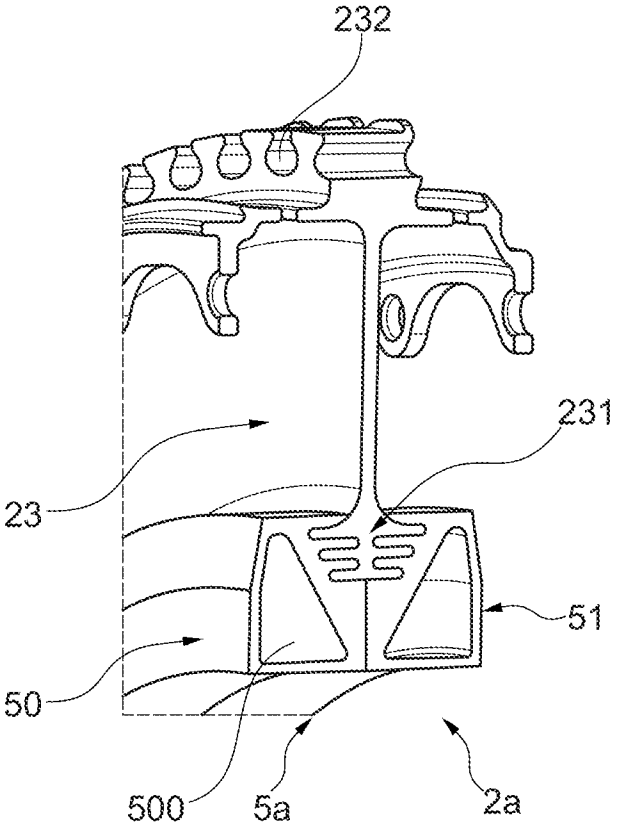
FIGS. 3A-3B shows, by sections and in sectioned perspective view, embodiment variants of a blade carrier of a rotor blade assembly group according to the invention with a firtree-shaped profile of the connection area, wherein, on the one hand, the blade carrier has rotor blades (FIG. 3A) that are formed integrally therewith and, on the other hand, is provided for separately manufactured rotor blades which are to be fixated thereat (FIG. 3B).
Figure 3A:
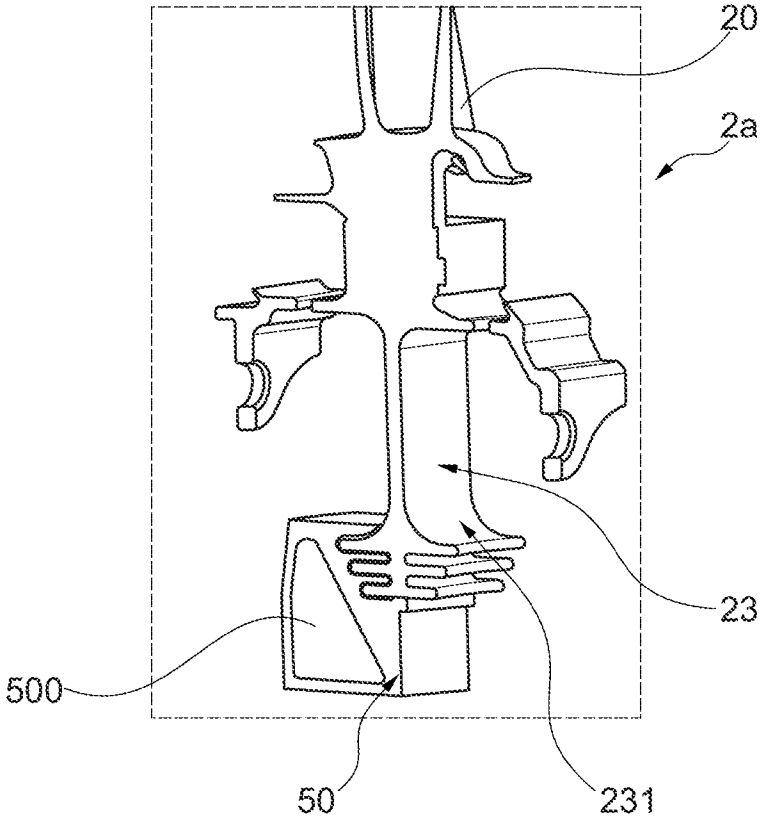

In FIGS. 3A and 3B, two different variants of the blade carrier 23 of the rotor blade assembly group 2*a* are illustrated. In both variants, the blade carrier 23 has a firtree-shaped cross sectional profile extending in the circumferential direction at the connection area 231 for the stiffening structure 5*a* and its stiffening rings 50 and 51 that are to be attached thereto. While in the variant of FIG. 3A, the blade carrier 23 is embodied with rotor blades 20 that are formed integrally thereat, the blade carrier 23 of FIG. 3B has multiple fastening grooves 232 arranged circumferentially next to each other for blade roots 200 of the rotor blades 20 that are to be fixated thereat.

Figure 4:
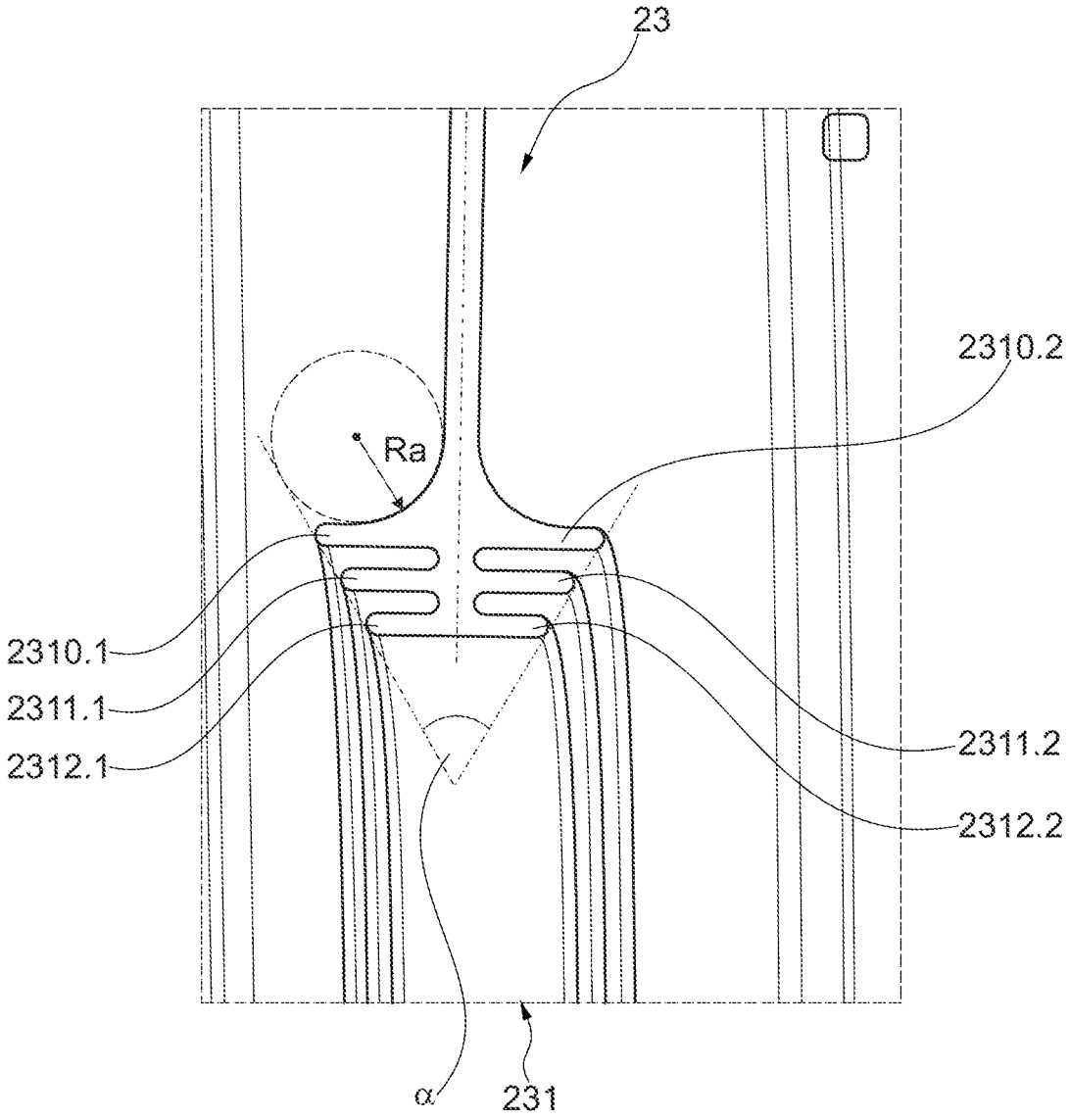
FIG. 4 shows, in sectioned and enlarged view, a variant of a connection area of the blade carrier with a firtree-shaped profile.

Regarding a firtree-shaped profile of the connection area 231 of a blade carrier 23, it is further illustrated by way of example based on the cross sectional rendering of FIG. 4 which constructional parameters can be used, where necessary, to influence the connection between the blade carrier 23 and the stiffening rings 50, 51, and thus the force transmission into the stiffening structure 5*a*. For instance, in the present case, a radius Ra for a transitional area between a radially extending face surface of the carrier section 230 and a radially outermost projection 2310.1 of a face side is shown, based on the size of which the degree of concavity of the transitional areas is influenced.

A geometry of the firtree-shaped profile can further be characterized by an angle α taken by two tangents with respect to each other, which are respectively applied in across the sectional view along the central axis M at the ends of the axial projections 2310.1 to 2312.1 or 2310.2 to 2312.2 of a face side. The larger the angle α, the larger the axial extension of the firtree-shaped profile and/or the larger the gradation in the axial extension between the projections 2310.1 to 2312.1 or 2310.2 to 2312.2 that are provided at a face side.

PARTS LIST

11 low-pressure compressor
12 high-pressure compressor
13 high-pressure turbine
14 medium-pressure turbine
15 low-pressure turbine
20, 21, 22 rotor blade
200, 210, 220 blade root
23, 24, 25 blade carrier
230, 240, 250 carrier section
231 connection area
2310.1, 2310.2, axial projection
2311.1, 2311.2,
2312.1, 2312.2
232 fastening groove
241 connection area
2410.1, 2410.2 axial projection
2*a*, 2*b*, 2*c* rotor blade assembly group
30, 31 guide vane
4.1, 4.2 flange connection
50, 51 stiffening ring (stiffening element)
50.1, 51.2 enclosing section
500 MMC core
500.1, 500.2, MMC section
500.3, 500.4
5*a*, 5*b* stiffening structure
6 tensioning part (connection element)
60, 61 face-side edge/leg
A outlet
B bypass channel
BK combustion chamber section
C outlet cone
E inlet/intake
F fan
FC fan housing
M central axis/rotational axis
O1, O2 passage hole
R entry direction
Ra radius
S rotor shaft
T turbine engine (gas turbine engine)
TT turbine
V compressor
α angle

The invention claimed is:

1. A rotor blade assembly group for an engine, comprising:

a ring-shaped or disc-shaped blade carrier including a plurality of rotor blades that are provided along a first circle line about a central axis of the rotor blade assembly group, the blade carrier including a carrier section that extends radially inwards in a direction toward the central axis with respect to the plurality of rotor blades, the carrier section comprising a connection area positioned at a radially innermost portion of the carrier section farthest from the plurality of rotor blades, at least one stiffening ring fixedly attached at the connection area of the carrier section, the at least one stiffening ring being arranged at a first or a second face side of the blade carrier, and the connection area of the carrier section including a profile that includes at least one axial projection, with the profile having a T-shaped, I-shaped, or fir tree shaped cross-section, the at least one stiffening ring engaging around the profile in a form-fit manner, such that the at least one axial projection is received at least partially between a radially outer section and a radially inner section of the at least one stiffening ring, wherein the blade carrier includes a passage hole that extends axially with respect to the central axis and that is radially delimited by a radially innermost edge of the carrier section, and a portion of the radially inner section of the at least one stiffening ring axially extends radially inwardly of the radially innermost edge of the carrier section and is positioned directly radially between the central axis and the radially innermost edge of the carrier section, wherein the at least one stiffening ring is separate from a connection component that connects the blade carrier to at least one other adjacent blade carrier.

2. The rotor blade assembly group according to claim 1, wherein:

the at least one stiffening ring includes a first stiffening ring and a second stiffening ring, the first stiffening ring and the second stiffening ring fixedly attached at the connection area of the carrier section, the first stiffening ring is arranged at the first face side of the blade carrier and the second stiffening ring is arranged at the second face side of the blade carrier, such that the second face side is facing away from the first face side, and the first and second stiffening rings are connected to the connection area of the carrier section and in addition are connected to each other.

3. The rotor blade assembly group according to claim 2, further comprising a fastener connecting the first and second stiffening rings to each other.

4. The rotor blade assembly group according to claim 3, wherein a section of the fastener axially extends radially inwardly of the radially innermost edge of the carrier section and is positioned directly radially between the central axis and the radially innermost edge of the carrier section.

5. The rotor blade assembly group according to claim 3, wherein the fastener at least partially encloses the first and second stiffening rings, such that at least parts of both the first and second stiffening rings are received between two respective sections of the fastener in a cross-section along the central axis.

6. The rotor blade assembly group according to claim 3, wherein the fastener is formed as a spring tensioner supported at both the first and second stiffening rings in a form-fit matter or a force-fit matter, and such that the spring tensioner exerts a force on at least one of the first and second stiffening rings, the force acting in a direction toward the other of the first and second stiffening rings.

7. The rotor blade assembly group according to claim 2, wherein at least one of the first stiffening ring and the second stiffening ring is made of a metal matrix composite.

8. The rotor blade assembly group according to claim 2, wherein at least one of the first stiffening ring and the second stiffening ring includes an internal core made of a metal matrix composite.

9. The rotor blade assembly group according to claim 8, wherein the at least one stiffening ring that includes the internal core made of the metal matrix composite is configured such that the internal core made of the metal matrix composite axially extends radially inwardly of the radially innermost edge of the carrier section and is positioned directly radially between the central axis and the radially innermost edge of the carrier section.

10. The rotor blade assembly group according to claim 1, wherein the profile of the connection area of the carrier section that has the T-shaped, I-shaped, or fir tree shaped cross-section extends along a second circle line about the central axis of the rotor blade assembly group at least in certain sections.

11. A gas turbine engine with at least one rotor blade assembly group according to claim 1.

* * * * *